US005193804A

United States Patent [19]

Smit

[11] Patent Number: 5,193,804

[45] Date of Patent: Mar. 16, 1993

[54] AUTOMATIC PIN SETTING APPARATUS

[75] Inventor: Jan W. Smit, Malden, Netherlands

[73] Assignee: Bowling- en Kegelcentrum Nijmegen B.V., Netherlands

[21] Appl. No.: 594,277

[22] Filed: Oct. 9, 1990

[30] Foreign Application Priority Data

Oct. 12, 1989 [NL] Netherlands ..... 8902532

[51] Int. Cl.[5] ..... A63D 5/08

[52] U.S. Cl. ..... 273/42 R; 273/43 D; 273/54 A

[58] Field of Search ..... 273/37, 42 R, 43 R, 273/43 D, 46, 53, 54 R, 54 A, 42 A; 408/235; 414/601, 673; 248/331, 575, 631, 648, 601, 602, 673

[56] References Cited

U.S. PATENT DOCUMENTS

| | | | |
|---|---|---|---|
| 2,620,187 | 12/1952 | Whipple et al. | 273/49 |
| 2,644,307 | 7/1953 | Blair | 273/42 A |
| 2,697,605 | 12/1954 | Montooth et al. | 273/54 A |
| 2,997,301 | 8/1961 | Zuercher | 273/43 |
| 3,048,398 | 8/1962 | Kalbfleisch | 273/43 |
| 3,056,604 | 10/1962 | DeFord | 273/43 A |
| 3,315,961 | 4/1967 | Congelli et al. | 273/43 A |
| 3,327,571 | 6/1967 | Sawada | 408/235 |
| 3,756,598 | 9/1973 | Maeda | 273/46 X |
| 4,026,552 | 5/1977 | Schmid | 273/49 |
| 4,289,441 | 9/1981 | Inada et al. | 414/673 X |

FOREIGN PATENT DOCUMENTS

| | | | |
|---|---|---|---|
| 25343 | 8/1967 | Australia . | |
| 1478226 | 6/1969 | Fed. Rep. of Germany | 273/54 A |
| 2528414 | 6/1975 | Fed. Rep. of Germany . | |
| 1425830 | 5/1965 | France . | |
| 1092415 | 11/1967 | United Kingdom . | |

*Primary Examiner*—V. Millin
*Assistant Examiner*—William M. Pierce
*Attorney, Agent, or Firm*—Peter L. Michaelson

[57] ABSTRACT

An automatic bowling pin setting apparatus for setting pins in a given pattern upon a pin deck at the end of a bowling lane, said apparatus comprising a set up frame adapted to be moved up and down above the pin deck by means of racks and pinions meshing therewith, said racks being mounted on columns mounted laterally and in which frame pin bins are bearing-mounted according to said pattern for tilting movement between a horizontal pin pick-up position and a vertical pin put-down position, said apparatus further comprising an assembly of substantially horizontal conveyors for distributing the pins to the pin bins and an elevator for supplying the distribution conveyors with pins knocked down and removed from the pin deck by a sweep barrier, wherein the driving gears of the set up frame (10) and the sweep barrier (6) are separated and the set up frame motor (15) drives the pinions (13), the set up frame (10) being supported in its upward movement by air ram cylinders (17) and the sweep barrier (6) being so controlled that the horizontal movement of the sweep barrier (6) proceeds at a relatively high speed, while the upward and downward pivoting movement proceed at reduced speed.

3 Claims, 2 Drawing Sheets

AUTOMATIC PIN SETTING APPARATUS

FIELD OF THE INVENTION

The invention relates to an automatic bowling pin setting apparatus for setting pins in a given pattern upon a pin deck at the end of a bowling lane, said apparatus comprising a set up frame adapted to be moved up and down above the pin deck by means of racks and pinions meshing therewith, said racks being mounted on columns mounted laterally and in which frame pin bins are bearing-mounted according to said pattern for tilting movement between a horizontal pin pick-up position and a vertical pin put-down position, said apparatus further comprising an assembly of substantially horizontal conveyors for distributing the pins to the pin bins and an elevator for supplying the distribution conveyors with pins knocked down and removed from the pin deck by a sweep barrier.

BACKGROUND OF THE INVENTION

An automatic bowling pin setting apparatus of known type is used in bowling alleys, setting ten pins in a triangular pattern on a pin deck. When pins remain upright after the first shot, they are picked up vertically and, after the pins that have been knocked down have been removed by a horizontal movement of the sweep barrier over the pin deck, are replaced for the second shot in the positions they were in after the first shot (possibly "off-spot").

To put down ten pins prior to the first shot in a frame of shots, the set up frame, comprising ten pin bins each holding a pin, moves down, the pin bins tilting into the vertical position and the pins being taken hold of by shutters locking around the necks of the pins. Once the pins are positioned on the deck, the shutters open and the set up frame moves upwards again. After the first shot the set up frame moves downwards onto the pins. Detectors equipped with electrical switches detect which pins have been knocked down and show the score on an electrical score board. Tongs which are mounted on the set up frame and driven by an electric motor mounted on the set up frame lock around the necks of the pins that have remained upright. Then the set up frame moves upward to enable the sweep barrier to sweep the pins that have been knocked down to the end of the pin deck onto a wide rotating belt which feeds the pins to the elevator. When the sweep barrier has returned to its position in front of the pin deck, the set up frame moves downward to reposition the pins which were lifted temporarily. Then the set up frame moves upwards again to be filled completely.

The sweep wagon is mounted in side gutters of the machine frame by means of wheels and prior to the first shot is held in a raised position so that the lane is clear for a ball to roll to the pin deck. When the ball passes a ray of light that is provided at a distance of about one meter before the first pin, a magnet on a member of the sweep barrier control mechanism is attracted in such a way that a hook at the end of the member will tilt, thus releasing the sweep barrier which will come down and can be moved backwards and forwards again by means of driving rods which are driven by a sweep barrier motor via a transverse crank shaft. The apparatus comprises an electronic control system.

A disadvantage of the known apparatus is that the drive line of the set up frame is long and complicated and, moreover, the drive of the sweep barrier, where it concerns lifting the sweep barrier to move it out of the path of an approaching ball, is taken off the drive of the set up frame. A set up frame motor comprising an electromagnetic brake drives a gear box via a V belt. By means of a chain a big open chainwheel is driven which also serves as a crank wheel for lifting the sweep barrier. The shaft of the big chainwheel extends right through the frame to the other side of the machine for operating a crank arm, the crank comprising a journal with a chain. This chain runs over a gear wheel mounted on top of a so-called tower comprising one of the pipe-shaped columns and is connected to this column by means of a freewheel coupling permitting the set up frame to be lowered either to the level of the pin deck or to the upper level of the pins standing on the pin deck. When the set up frame is moved up and down, via the rack of this column a pinion is operated. The shaft of this pinion extends right through the machine frame to a similar pinion meshing with the rack of the second column arranged at the other end of the machine.

The disadvantages of this long drive line to the two columns on opposite sides of the set up frame are:

a. Due to play developing after only a relatively short time in the plastic gears of both the gear box and the drive of the rack, slack in the chains and torsion in the long transverse driving shafts, uneven drive transmission to the left-hand and the right-hand part of the set up frame will occur, causing the set up frame to lean and increasing the chance of faults in detecting and replacing pins that were not knocked down after the first shot.

b. In the case of chain fracture, the set up frame will crash, and if any pins are present on the pin deck at the time, the columns of the set up frame and their guiding parts will be severely damaged.

c. Due to metal fatigue developing in the driving shafts in the course of time, their torsion strength will also decrease, thus rendering adjustment of the set up frame more difficult.

A drawback of the known apparatus as far as the control of the sweep barrier is concerned is the following. As observed above, the drive of the sweep barrier is partly taken off the drive of the set up frame, namely off the big open chainwheel, which serves as a driving crank wheel for picking up the sweep barrier. For that purpose a crankpin is welded onto the big chainwheel, which crankpin, via a chain, drives a member with a hook, which member is adapted for up and down movement at an angle to the horizontal. The hook can engage the suspension of the sweep barrier. This fairly complicated composite injection-moulded member lifts the sweep barrier when it is in the frontmost position after the first and after the second shot. Because the sweep barrier is lifted from a stationary position by a rotating crank wheel, periodically abrupt traction forces will be exerted generating shockloads in the apparatus. The sweep barrier is lowered by gravity, the fall of the barrier being dampened by a damper device.

The drive of the sweep barrier in respect of its backward and forward movement over the pin deck is powered by its own motor. The rotary movement of the sweep barrier motor, comprising a mechanical motor brake, is converted to a linear movement by means of cranks. Serious problems in adjusting the machine will arise due to the fact that the right-hand crank arm is detachably mounted onto the transverse shaft of the sweep carrier and play in this connection will develop soon. Long arms connected to this transverse shaft and used for moving the sweep barrier forwards and backwards, can tear easily at the joints.

SUMMARY OF THE INVENTION

The present invention aims to provide a bowling pin setting apparatus in which these disadvantages are overcome.

According to the invention the driving gears for the set up frame and the sweep barrier are separated and the set up frame motor drives the pinions, the set up frame being supported in its upward movement by air ram cylinders and the sweep barrier being so controlled that the horizontal movement of said sweep barrier proceeds at a relatively high speed while the upward and downward pivoting movements proceed at reduced speed.

The drive of the pinions requires only a short drive line and due to the assistance of the air ram cylinders in supporting the set up frame, the strain on the pinions meshing with the racks and the gears of the gear box is only slight. The set up frame will not tend to lean anymore and in the case of a disturbance in the drive the fall of the set up frame will be broken by the air ram cylinders. The construction is simplified in that inter alia the big open chainwheel, the control chain and the tower that was needed for guiding the control chain into a column, as well as various transverse shafts and struts can be left out, which improves the accessibility of the machine for the purpose of maintenance and the like.

In a further elaboration of the invention, in a pin setting apparatus in which the sweep barrier is controlled by means of a wagon on which the sweep barrier is mounted at a fixed angle, the wheels of the wagon running in side gutters, according to the invention second guiding gutters are provided on opposite sides of the frame above the aforementioned gutters, these second guiding gutters having a vertical guiding bend in which the wheels of the sweep barrier wagon run, the wagon being driven by a two-speed, reversible motor. Thus the guidance of the sweep barrier is carried out on opposite sides by rollers running in a first guiding gutter and a second guiding gutter or control gutter arranged above said first guiding gutter, which provides a more robust guidance than guidance by means of only a single gutter on each side, and the sweep barrier guidance will have improved resistance to loads due to balls being rolled against the sweep barrier accidentally, when the sweep barrier is in the lowered position.

Abrupt tractive forces generated during operation of the sweep barrier are avoided because the sweep wagon to which the sweep barrier is connected, upon entering the guiding bend is gradually pivoted upwardly, the sweep barrier being tilted upwardly along with it. Further, to start up the movement of the sweep barrier, proximity sensors may be used for controlling the two-speed sweep barrier motor which is reversible in the direction of rotation. The chains may be kept tensioned by means of tensioning mechanisms equipped with tensioning springs. Dampers for absorbing the fall movement of the sweep barrier can be omitted.

The pin setting apparatus according to the invention may further comprise means for prolonging the life and limiting the amount of service required by the various parts.

Behind the pin deck a transport carpet is provided comprising an endless belt guided over reversing rollers, sloping backwards from the pin deck and transporting sideways for supplying balls to the ball return mechanism and pins to the elevator. In the known apparatus the rear reversing roller is conventionally fitted with bearing journals for adjustment in slot holes for tensioning and directing the belt. Thus it frequently happens that the thread in the rear reversing roller shaft journals is damaged and the reversing roller shaft becomes warped, causing the bearings to wear out rapidly. According to the invention this drawback is obviated by providing a spring-loaded tensioning mechanism at the shaft of the rear reversing roller and mounting the reversing roller on the shaft in a plurality of bearings.

Further, in such a pin setting apparatus a ball barrier is provided in the form of a crossplate covered with resilient material, which plate is mounted on rocking arms and stops the balls rolling over the pin deck, thus dropping them onto the ball transport carpet. According to the invention the rocking arms are directly connected to one end of shock absorbers equipped with resetting springs, the other end of the absorbers being connected to the machine frame.

It is observed that it is known per se from U.S. Pat. No. 3,056,604 to use separate driving gears for the set up frame and the sweep barrier in an automatic pin setting apparatus, with the set up frame being connected to air cylinders. However, this concerns an apparatus designed for a miniature bowling alley. The air cylinders are not air ram cylinders that are adapted to linearly support the lifting movement of the set up frame, but air cushions damping the lowering movement of the set up frame. This lowering movement is a free fall movement limited by a catch slipping into notches. Such a free fall movement of the set up frame is impossible in a full-size automatic pin setting apparatus the weight of whose set up frame is of the order of 120 kg. There is another reason why this known apparatus is unsuitable for a full-size automatic pin setting apparatus. The sweep barrier is mounted directly on two endless chains on opposite sides of the lane driven at a constant speed, and these chains are provided in the location where according to the FIQ (Tenpin Division Playing Rules and Regulations) buffer plates, so-called "kick-backs", should be present.

BRIEF DESCRIPTION OF THE DRAWINGS

To elucidate the invention, one embodiment of the pin setting apparatus will be described, by way of example, with reference to the accompanying drawings, in which.

DETAILED DESCRIPTION

Figure 1:
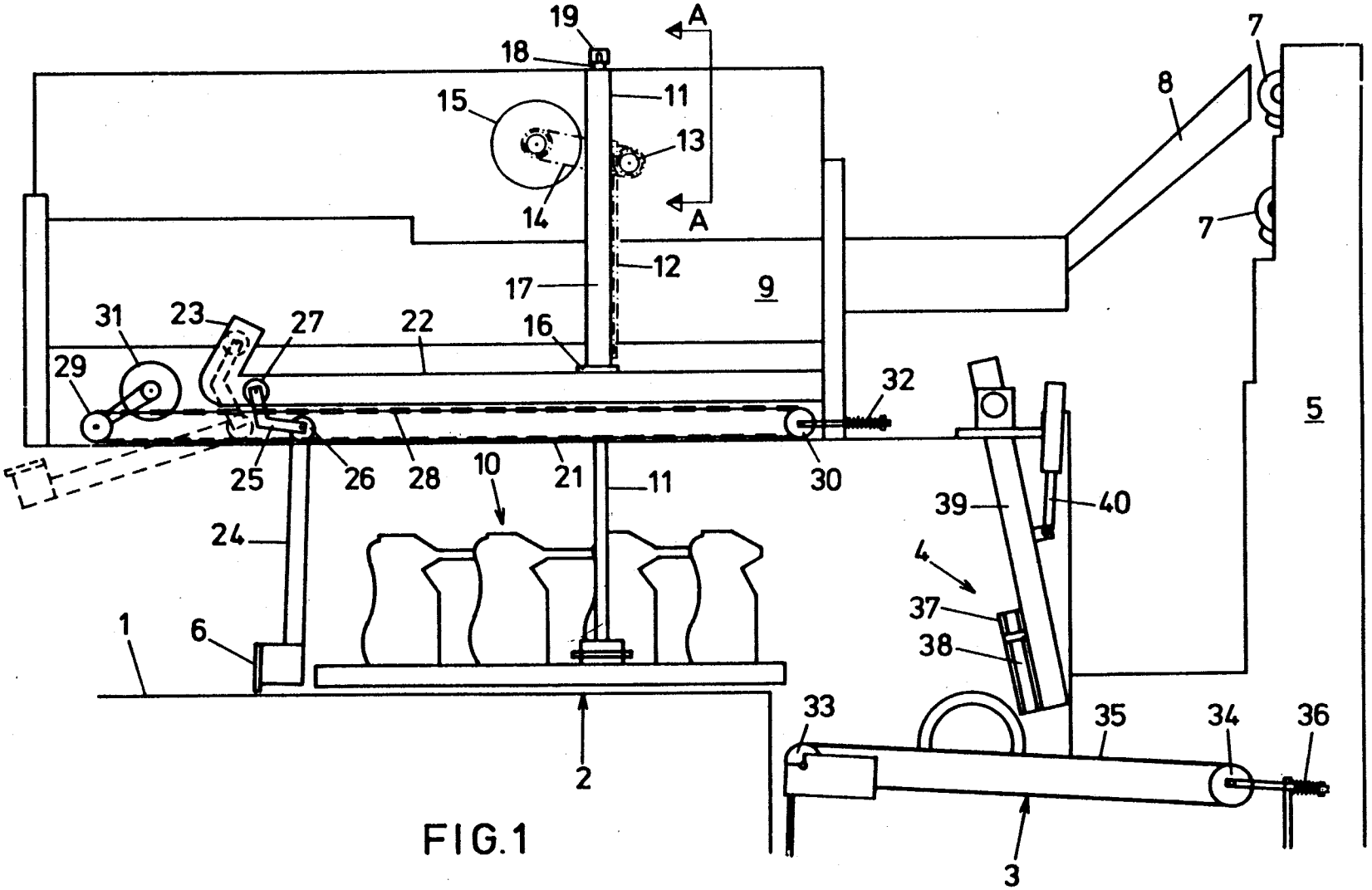
FIG. 1 is a schematic side view of the pin setting apparatus viewed from the right in the direction of the bowling lane.

The drawings, in which all parts of the apparatus have been left out which are not directly relevant to the invention, show a bowling lane 1 with a pin deck 2 at the end of it. Behind the pin deck there is a ball transport carpet 3, a ball barrier 4, and a pin elevator 5. The elevator 5 carries pins 7 that have been knocked down and swept backwards over the pin deck 2 by a sweep barrier 6, upwards to a chute 8 from which the pins are supplied to a pin distributor 9 filling pin reception bins (not shown) of a set up frame 10 with pins.

The lifting devices for the set up frame 10 and the drive of the sweep barrier 6 will be described in more detail.

Figure 1A:
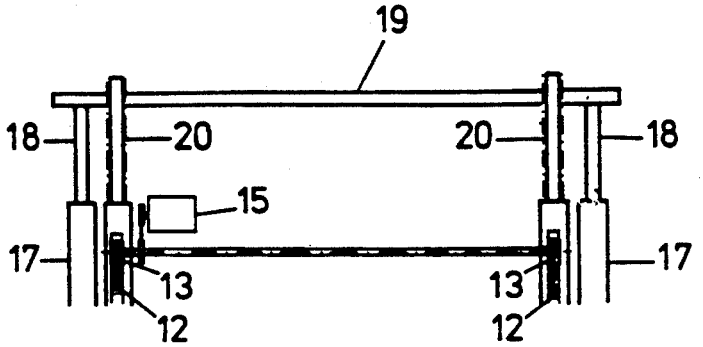
FIG. 1A is a view taken on the arrow line A—A of FIG. 1.
Figure 2:
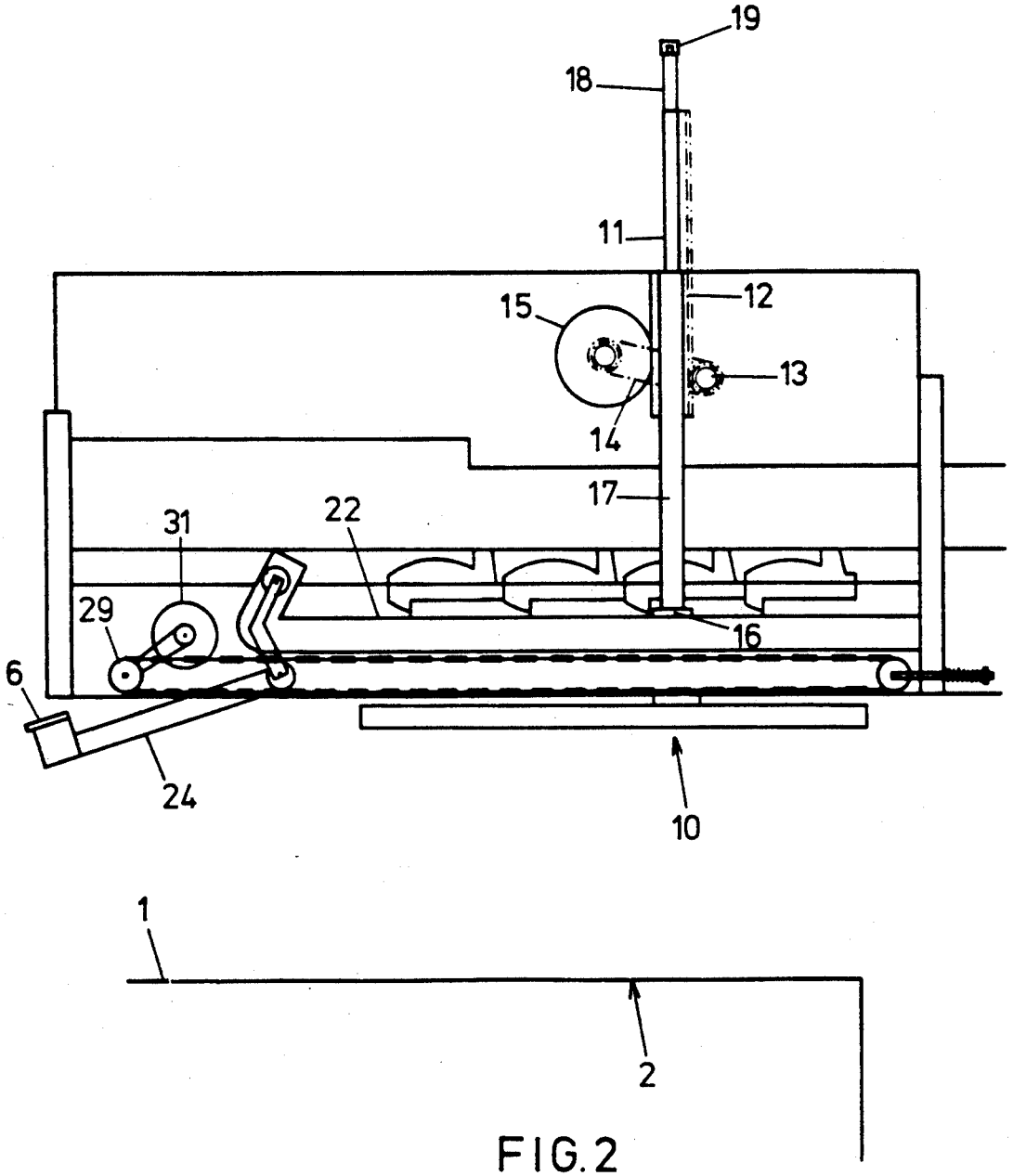
FIG. 2 is a side view of a part of the apparatus in a different operative position from that shown in FIG. 1.

Referring to FIGS. 1 and 1A, columns 11 are laterally mounted on the set up frame 10 for lifting the set up frame 10, shown in its lowered position. The columns are provided with racks 12. Each of the racks 12 engages with a pinion wheel 13. The pinions 13 are mutually connected by a shaft extending transversely across the machine and a chain 14 engages with one of the pinion wheels, the chain 14 being driven by a set up frame motor 15 via a gear box (not shown). Directly beside each column 11 an air ram cylinder 17 extends upwardly from the machine frame 16. The piston rods 18 of the cylinders 17 are mutually connected by a traverse 19 extending above the upper ends of the columns 11 and connected to the columns, for instance by means of threaded rods 20. The pneumatic control of the cylinders 17 is preferably such that an upwardly directed force is continuously exerted on the set up frame, this upward force substantially taking up the weight. Accordingly, the pinions 13 need to exert only a small driving force. When these driving forces drop out, for instance when the chain 14 breaks, the set up frame will not crash beyond control, but its fall will be pneumatically broken. FIG. 2 shows the set up frame 10 in the raised filling position.

The control gear of the sweep barrier 6 comprises a first guiding gutter 21 on each side of the apparatus and a second guiding gutter 22 arranged above gutter 21, the second gutter 22 having an ascending bend 23. The sweep barrier 6 is mounted onto two arms 24 whose upper ends are fixedly attached to angled arms 25. At the ends of arms 25 wagon wheels 26 and 27 are provided running in the first gutter 21 and the second gutter 22, respectively. In the embodiment shown the wheels 26 in the lower gutter 21 are connected to a chain, a toothed belt or a similar tractive part 28 which is guided over reversing rollers 29, 30 and is driven by a two-speed sweep barrier motor 31 with a reversing device, controlled by proximity switches (not shown) on the driving chain or belt. The chain or belt 28 is tensioned by a spring-loaded tensioning mechanism 32.

The sweep barrier operates as follows:

In FIG. 1 the sweep barrier 6 is shown in the lowered position as indicated by the solid lines. The wagon wheels 26 and 27, forming the sweep barrier wagon together with the arms 25, can be moved to the right in the respective gutters 21 and 22 by the sweep barrier motor 31. Assuming that the set up frame 10 is in the raised position as shown in FIG. 2, the sweep barrier 6 can be moved backwards so as to sweep the pins present on the pin deck 2 backwards so that they can be carried up to the chute 8 by the elevator 5 and further to the pin distributor 9 which sets the pins in the pin bins of the set up frame 10 in the raised position.

Then the sweep barrier is moved forward again, the set up frame sinks to the pin deck to set down a set of pins and the sweep barrier must be pivoted upwardly before the first ball is shot. The upward pivot of the sweep barrier is effected by moving forward the wagon 25, 26, 27 so far that the wheels 27 are pushed into the respective ascending bends 23. The wagon 25–27 pivots, and the arms 24 along with the sweep barrier 6 assume the position indicated by the broken lines in FIG. 1. For the sweep barrier to be lowered it is sufficient for the wagon 25–27 to be moved backwards so far that the wheels 27 move out of the bends 23 into the adjacent straight parts of the gutters 22.

Behind the pin deck 2 the ball transport carpet 3 is provided comprising an endless belt guided over reversing rollers 33, 34. To keep the rear reversing roller 34 tensioned it is provided with a spring-loaded tensioning mechanism 36.

The ball barrier 4 is arranged behind the pin deck 2 and comprises a plate 38 covered with resilient material 37, the plate being bearing-mounted in the machine frame by means of rocking arms 39. The rocking arms are directly connected to one end of shock absorbers 40 equipped with resetting springs, the other end of the absorbers being connected to the machine frame.

I claim:

1. An automatic bowling pin setting apparatus for setting pins in a given pattern upon a pin deck at an end of a bowling lane, said apparatus comprising a set up frame adapted to be moved up and down above the pin deck and relative to a stationary machine frame by means of racks and pinion gears meshing therewith, said set up frame having opposing sides, said racks being mounted on vertically oriented columns mounted to said opposing sides of said set up frame and a plurality of frame pin bins are bearing mounted to said set up frame according to said pattern for tilting movement between a horizontal pin pick-up position and a vertical pin put-down position, said apparatus further comprising an elevator for supplying pins knocked down and removed from the pin deck by a sweep barrier to a pin distributor for routing to ones of said frame pin bins, characterized in that air ram cylinders (17) attached between said machine frame (16) and said set up frame (10) substantially support said set up frame (10)) during said set up frame movement, a set up frame motor (15) fixedly attached to said machine frame (16) drives the set-up frame pinion gears (13) to control the set up frame motion, and the sweep barrier (6) includes means for controlling said sweep arm horizontal movement whereby upward and downward movement of said set up frame (10) is provided at a reduced speed with respect to said horizontal movement of said sweep barrier (6), said sweep barrier is controlled using wheels running in side gutters, said wheels being mounted on a wagon on which the sweep barrier is mounted at a fixed angle, characterized by second guiding gutters (22) arranged on opposite sides of the machine frame (16) above said first gutters (21), said second guiding gutters having a vertical guiding bend (23) for receiving the wheels of the sweep barrier wagon (25–27), the sweep barrier (6) being connected to the wagon (25–27) at a fixed angle and the wagon being driven by a two-speed reversible motor (31).

2. An apparatus according to claim 1, characterized in that for activating the sweep barrier (6) proximity switches are used for control of the two-speed sweep barrier motor (31) which is reversible in a direction of rotation.

3. An apparatus according to claim 1, characterized in that the drive belts (28) are kept tensioned by means of spring-equipped tensioning mechanisms (32).

* * * * *